United States Patent [19]

Flaig

[11] Patent Number: 5,044,335

[45] Date of Patent: Sep. 3, 1991

[54] MONITORING ARRANGEMENT FOR A FUEL FILTER

[75] Inventor: Ulrich Flaig, Markgröningen, Fed. Rep. of Germany

[73] Assignee: Robert Bosch GmbH, Stuttgart, Fed. Rep. of Germany

[21] Appl. No.: 548,902

[22] PCT Filed: Aug. 25, 1989

[86] PCT No.: PCT/DE89/00557

§ 371 Date: Jun. 26, 1990

§ 102(e) Date: Jun. 26, 1990

[87] PCT Pub. No.: WO90/06437

PCT Pub. Date: Jun. 14, 1990

[30] Foreign Application Priority Data

Nov. 26, 1988 [DE] Fed. Rep. of Germany ..... 3839960

[51] Int. Cl.[5] ..... F02B 77/00

[52] U.S. Cl. ..... 123/198 D; 210/85

[58] Field of Search ..... 123/198 D; 210/85, 96.1

[56] References Cited

U.S. PATENT DOCUMENTS 4,034,335 7/1977 Harazoe et al. ..... 123/340

4,562,431 12/1985 Jahnke et al. ..... 210/85

OTHER PUBLICATIONS

"Digitale Diesel-Elektronik beim BMW-Turbodieselmodell 324td", by G. Schwarzbauer et al., Motortechnische Zeitschrift 49 (1988) 1, pp. 37 to 41.

*Primary Examiner*—Noah P. Kamen

*Attorney, Agent, or Firm*—Walter Ottesen

[57] ABSTRACT

A monitoring arrangement for a fuel filter of a diesel internal combustion engine is described. The metering of fuel of the diesel internal combustion engine is open-loop controlled or closed-loop controlled by an electronic control unit. This control unit influences the supply voltage of the sensor and evaluates its output signals for monitoring the function of the fuel filter.

13 Claims, 1 Drawing Sheet

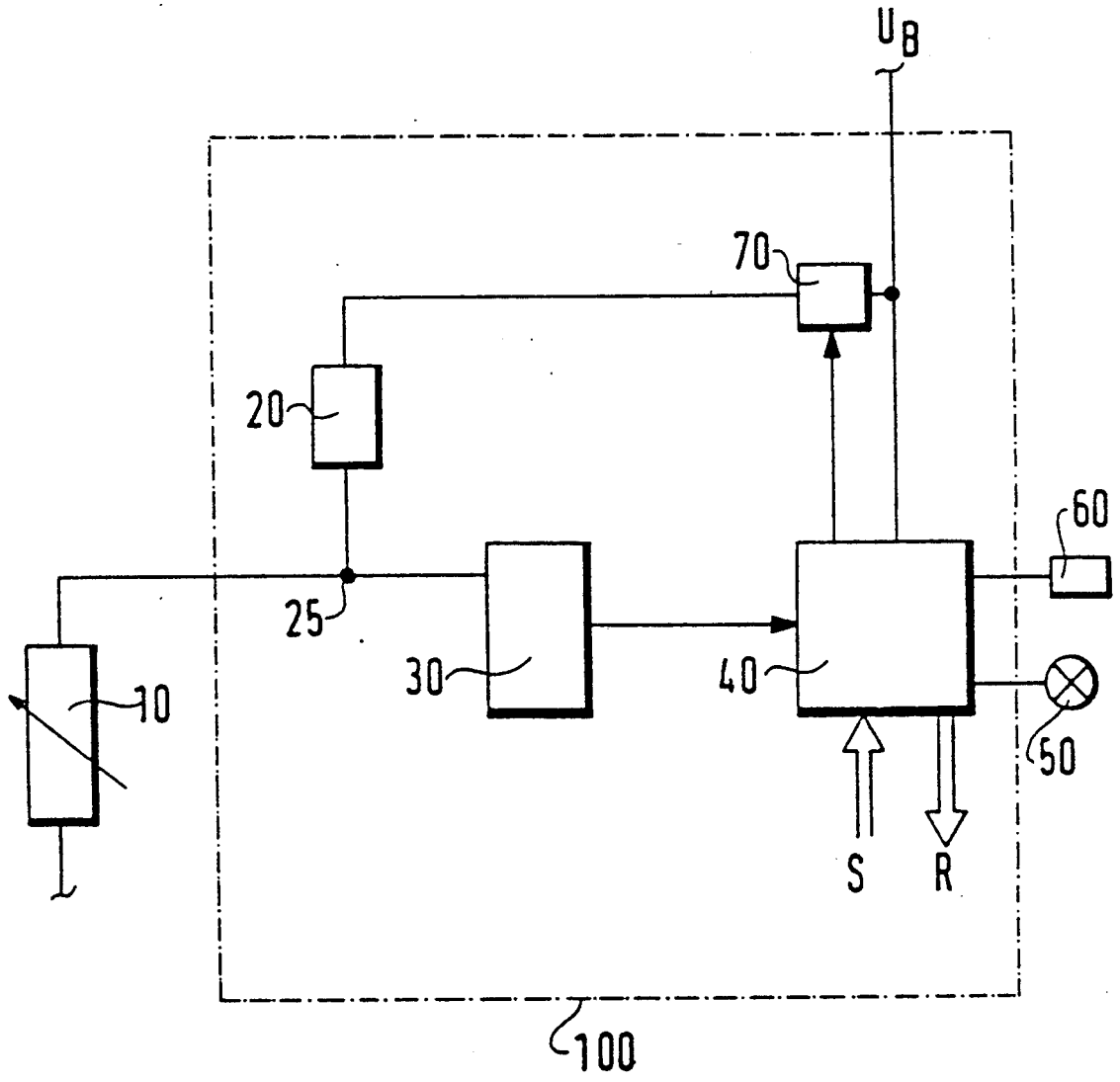
$U_B$
70
20
60
25
30
40
10
50
S
R
100

MONITORING ARRANGEMENT FOR A FUEL FILTER

FIELD OF THE INVENTION

The invention relates to a monitoring arrangement for a fuel filter. One such monitoring arrangement for a fuel filter is known from U.S. Pat. No. 4,562,431. There, a fuel filter having a water level sensor is described. A warning light is driven from an evaluation electronics when the water level in the fuel filter exceeds a predetermined level. A separate electronics is necessary for the water level sensor and this electronics has no connection whatsoever to other monitoring arrangements or means for controlling or regulating the internal combustion engine.

BACKGROUND OF THE INVENTION

An electronic diesel regulation is described in the "Motortechnische Zeitschrift" 49 (1988), pages 37 to 41. This arrangement regulates or controls different variables such as fuel quantity, rotational speed and injection start in dependence upon various sensor signals. All closed-loop and open-loop functions are monitored. An emergency driving operation is initiated when individual components of the open-loop or closed-loop control become inoperative or defective with the fault being simultaneously stored. In this way, the fault can be easily localized during maintenance work. With this arrangement, faults of individual components of the open-loop or closed-loop control of the internal combustion engine are monitored.

SUMMARY OF THE INVENTION

It is an object of the invention to combine a monitoring arrangement for a fuel filter with an arrangement for electronically controlling a diesel engine. The control arrangement for the internal combustion engine is intended to apply a supply voltage to a residue sensor and monitor the output signal of the sensor.

An arrangement of this kind affords the advantage that no separate control apparatus is needed for the sensor. A plurality of possible reactions to a limited functional capability of the fuel filter is possible by means of this combination. The invention is explained below with respect to the embodiment shown in the drawing.

BRIEF DESCRIPTION OF THE DRAWING

An embodiment of the invention is shown in the drawing and is explained in greater detail in the following description.

DESCRIPTION OF THE PREFERRED EMBODIMENTS OF THE INVENTION

The drawing shows a monitoring circuit 100 for a residue sensor 10. The residue sensor 10 is illustrated as a variable resistor in the drawing. The residue sensor is hereinafter referred to as a sensor. The sensor is connected via a connecting node 25 to a series circuit comprising a resistor 20 and a switching unit 70 on the one hand and to a protective circuit 30 on the other hand. The protective circuit 30 and the switching unit 70 are connected to the control unit 40 of the electronic diesel control. The control unit 40 receives various sensor signals characterizing the operational condition of the internal combustion engine and generates at least one open-loop and closed-loop variable R influencing the internal combustion engine. The control unit 40 further applies signals to an indicator device 50 and/or to a diagnostic interface 60.

The sensor 10 is supplied with a supply voltage $U_B$ by a switching unit 70 via a resistor 20. The resistor 20 determines the current flowing through the sensor 10. The current through the sensor must be held low because of the electrolysis occurring at specific sensors.

The sensor signal present at the connecting node 25 is applied to the control unit 40 via the protective circuit 30. The signal is filtered, evaluated and, if required, permanently stored in the control unit 40. The control unit 40 generates a warning signal when a predetermined residue quantity is reached which corresponds to a specific output signal of the residue sensor. A fault indicator 50 is driven in dependence upon this warning signal. The driver can then immediately recognize therewith that the functional capability of the filter is limited.

The entire monitoring circuit 100 is integrated into the control apparatus of the control unit 40 or means of the control unit 40 already available are used.

If, notwithstanding a careful arrangement of the sensor 10 and resistor 20, an impermissibly high electrolysis does occur which could lead to the destruction of the sensor, then voltage can be applied to the sensor 10 only for short time durations by the switching unit 70 or the voltage present at the sensor 10 can be reversed in polarity at desired intervals.

In addition, the control unit 40 can activate the sensor for a short time only at specific time points via the switching unit 70; this can take place, for example, at specific operating conditions (at idle, after start or at definite time intervals). The warning signal can be permanently stored and can then be made available by request at a diagnostic interface 60 such as by means of a diagnostic system. In addition, the control unit 40 can influence the driving performance of the internal combustion engine in dependence upon the output signal of the sensor 10 in that the control unit limits for example the operating characteristic field or limits the quantity of fuel to be injected to specific values in dependence upon the sensor 10.

It is possible to influence the internal combustion engine in dependence upon the functional capability of the fuel filter with such a monitoring arrangement and simultaneously inform the driver with respect to the limited functional capability.

I claim:

1. A monitoring arrangement for a fuel filter of a diesel engine having operating characteristic variables and to which fuel is metered, the monitoring arrangement comprising:

a residue sensor for monitoring the functional capability of the filter and generating a sensor signal in dependence upon said functional capability;

an electronic control unit for controlling the fuel metered to the engine in dependence upon the operating characteristic variables of the engine and in dependence upon said sensor signal;

first circuit means interconnecting said residue sensor and said control unit for transmitting said sensor signal so as to permit said control unit to generate a warning signal dependent upon said functional capability; and, said second circuit means for enabling said control unit to activate said residue sensor at specific operating conditions of the engine which conditions include idle.

2. The monitoring arrangement of claim 1, further comprising voltage supply means for providing a supply voltage; and, said control unit being adapted to control said supply voltage to said residue sensor via said second circuit means.

3. The monitoring arrangement of claim 1, further comprising a fault indicator connected to said control unit.

4. The monitoring arrangement of claim 1, wherein said fault indicator is driven by said warning signal.

5. The monitoring arrangement of claim 3, further comprising a diagnostic interface also connected to said control unit.

6. The monitoring arrangement of claim 5, wherein said warning signal is made available to said diagnostic interface.

7. The monitoring arrangement of claim 1, wherein the engine has an operating characteristic field and the driving performance is influenced in dependence upon the filter function as sensed by the residue sensor by limiting the operating characteristic field of the engine.

8. The monitoring arrangement of claim 1, said second circuit means including switching means for activating said residue sensor for only a short time.

9. The monitoring arrangement of claim 8, wherein the engine has an operating characteristic field and the driving performance is influenced in dependence upon the filter function as sensed by the residue sensor by limiting the operating characteristics field of the engine.

10. A monitoring arrangement for a fuel filter of a diesel engine having operating characteristic variables, the monitoring arrangement comprising:

a residue sensor for monitoring the functional capability of the filter and generating a signal in dependence upon said functional capability;

an electronic control unit for controlling the fuel metered to the engine in dependence upon the operating characteristic variables of the engine;

circuit means for interconnecting said residue sensor and said control unit so as to permit said control unit to generate a warning signal dependent upon said functional capability; and, switching means connected to said control unit and being adapted for activating said residue sensor for only a short time at specific operating conditions of the engine which conditions include idle.

11. The monitoring arrangement of claim 10, wherein the engine has an operating characteristic field and the driving performance is influenced in dependence upon the filter function as sensed by the residue sensor by limiting the operating characteristic field of the engine.

12. A monitoring arrangement for a fuel filter of a diesel engine having operating characteristic variables, the monitoring arrangement comprising:

a residue sensor for monitoring the functional capability of the filter and generating a signal in dependence upon said functional capability;

an electronic control unit for controlling the fuel metered to the engine in dependence upon the operating characteristic variables of the engine;

circuit means for interconnecting said residue sensor and said control unit so as to permit said control unit to generate a warning signal dependent upon said functional capability; and, switching means connected to said residue sensor for supplying a voltage having a polarity to said residue sensor with said polarity alternating at specific intervals.

13. The monitoring arrangement of claim 12, wherein the engine has an operating characteristic field and the driving performance is influenced in dependence upon the filter function as sensed by the residue sensor by limiting the operating characteristic field of the engine.

* * * * *

UNITED STATES PATENT AND TRADEMARK OFFICE

CERTIFICATE OF CORRECTION

PATENT NO. : 5,044,335

DATED : September 3, 1991

INVENTOR(S) : Ulrich Flaig

It is certified that error appears in the above-identified patent and that said Letters Patent is hereby corrected as shown below:

On the title page, under item [86], lines 2 and 3: delete "Jun. 26, 1990" and substitute -- Jul 26, 1990 -- therefor.

In column 3, line 33: delete "characteristics" and substitute -- characteristic -- therefor.

Signed and Sealed this

Fourth Day of May, 1993

*Attest:*

Michael K. Kirk

MICHAEL K. KIRK

*Attesting Officer*

*Acting Commissioner of Patents and Trademarks*